US005779424A

United States Patent [19]

Stoffel

[11] Patent Number: 5,779,424

[45] Date of Patent: Jul. 14, 1998

[54] PROCESS FOR PRODUCING A TWO-CHAMBER PRESSURE PACKAGE

[76] Inventor: Gerd Stoffel, In Den Dorfackern 21, D-78465 Konstance, Germany

[21] Appl. No.: 418,207

[22] Filed: Apr. 7, 1995

[30] Foreign Application Priority Data

Apr. 18, 1994 [DE] Germany ..... 44 13 331.6

[51] Int. Cl.[6] ..... B21D 51/26

[52] U.S. Cl. ..... 413/1; 413/6

[58] Field of Search ..... 413/1, 4, 6, 22, 413/53, 55, 63; 72/254, 256; 29/469.5

[56] References Cited

U.S. PATENT DOCUMENTS 2,432,740 12/1947 Fink ..... 413/6

3,443,341 5/1969 Anthony ..... 72/256

3,466,908 9/1969 Whiteford ..... 72/256

3,695,081 10/1972 Gartner ..... 72/254

5,069,590 12/1991 Stoffel ..... 413/1

*Primary Examiner*—Kurt Rowen

*Attorney, Agent, or Firm*—Bachman & LaPointe, P.C.

[57] ABSTRACT

In the case of a process for producing a two-chamber pressure-package (R) an inner body (2) of fold-forming, respectively crumplable, material is connected with an outer casing (1) in the area of an adhesive layer (3). Then outer casing (1), adhesive layer (3) and inner body (2) together form a bead (7) around an opening (13). However, a ring (14) is removed from the outer casing before the bead (7) is formed.

2 Claims, 3 Drawing Sheets

PROCESS FOR PRODUCING A TWO-CHAMBER PRESSURE PACKAGE

BACKGROUND OF THE INVENTION

The invention concerns a process for producing a two-chamber pressure package with an outer casing, with which an inner body of fold-forming, respectively crumblable material is connected in the area of an adhesive layer, the outer casing, adhesive layer, and inner body around an opening together forming a bead.

A process of this kind is known from U.S. Pat. No. 5,069,590 and has proven itself to be very worthwhile. In addition to many advantages, particular mention is to be made of the leakage-free connection of outer casing and inner body, which is essential especially in the case of a pressurized inner space between outer casing and inner body.

SUMMARY OF THE INVENTION

The task of the present invention is to improve the process of the '590 patent and, in particular, with respect to the sealing, production, and appearance of the beaded edge.

The fact that a ring is removed from the outer casing and, in a given case, the inner body, before the bead is formed, leads to the solution of this task.

Up to now this ring between the actual edge of the opening and the beginning of the adhesive layer, respectively the edge of the inner body, was used to form the bead. at the same time often a piece of the adhesive layer, respectively the inner body, being beaded with it. Since as a rule this ring consists of smooth material, it became connected with the beading tool, so that here there is the danger of cold welding. Further, at the time of making the inner body glue projections often emerge from the edge of the inner body, which contaminate the beading tool and the bead.

A further disadvantage above all consists in the fact that when the outer casing is drawn in, the inner body forms folds, which extend into the bead. Since the edge of the inner body up to now lies at the beginning of the bead or slightly over it, this fold formation cannot be eliminated. The folds remain and lead to leakages.

The present invention eliminates all these disadvantages. By removing the ring of the outer casing preferably up to the edge of the adhesive, respectively the inner body, there are no projections of the adhesive on the bead nor is the smooth metal of the outer casing directly exposed to the attack of the bead tool.

Above all, however, the upper edge of the inner body is pressed firmly onto the adhesive layer, respectively the outer casing, by means of the rolling of the bead, so that the folds arising as a result of the drawing in are removed completely. For this purpose preferably the bead is rerolled after it is produced, using a tool which almost completely overlaps the edge of the bead with a fairly wide roller groove.

The two-chamber pressure package, which is produced according to this process in accordance with the invention has an extraordinarily high air-tightness, which is the advantage of this process in accordance with the invention.

In addition it should be pointed out that in the case of the new process invented folding does not have to be considered at all, so that a significantly higher number of drawing stages is possible, as in the case of producing known normal aerosol cans. This leads to the fact that the appearance of the entire upper area of a two-chamber pressure package, which is produced in accordance with this process, is improved significantly. Of course this is true of the bead itself, which now no longer has any notch formation or glue projections.

How the ring is removed from the outer casing is of minor significance. Preferably the ring is milled off, but all possible other methods of removal are conceivable.

BRIEF DESCRIPTION OF THE DRAWINGS

Further advantages, features, and details of the invention result from the following description of preferred embodiments as well as by means of the drawing; here

DETAILED DESCRIPTION

Figures 1A, 1B, 1C, 1D, 1E:
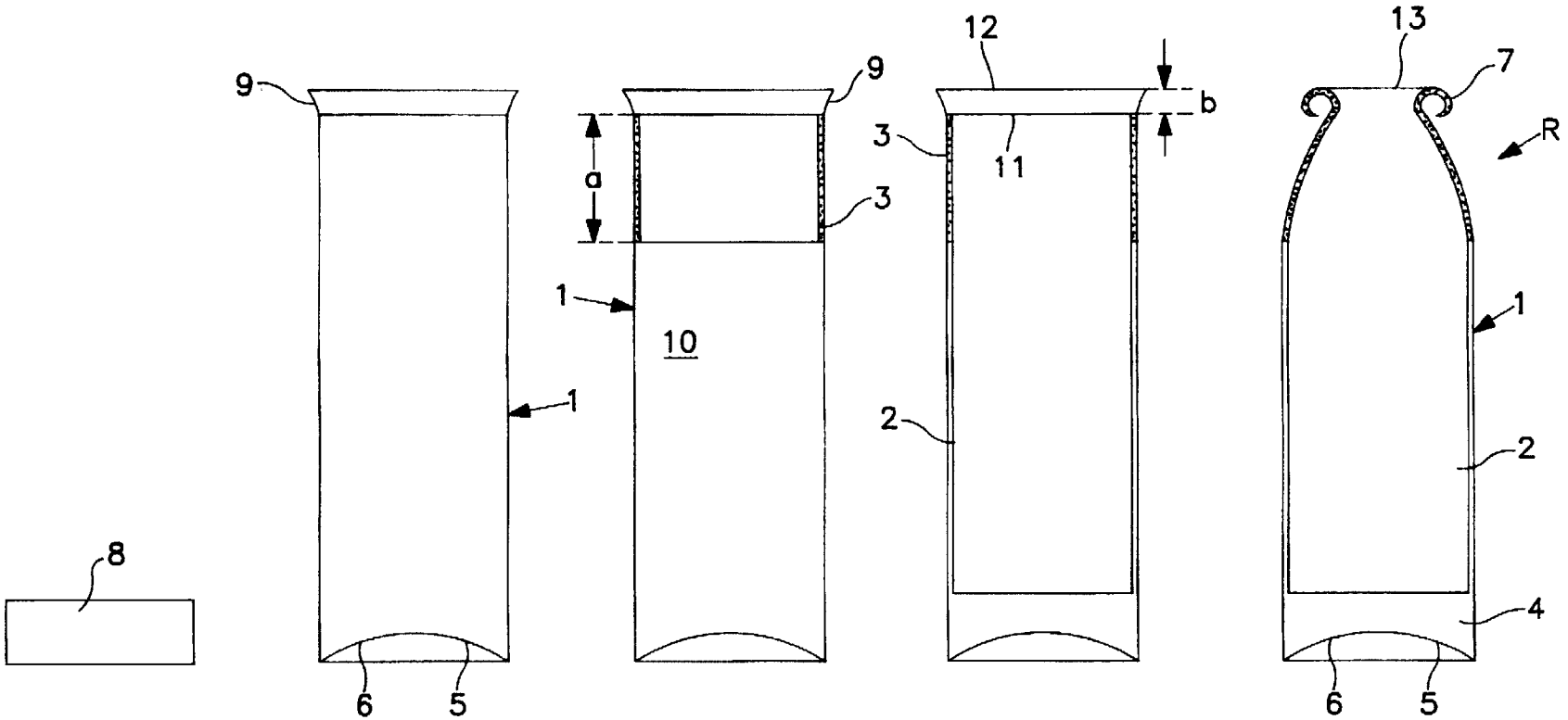
FIG. 1a PRIOR ART
FIGS. 1*a* through 1*e* show a cut top view of a two-chamber package in different stages of the process of its manufacture in accordance with the prior art.
Figure 2E:
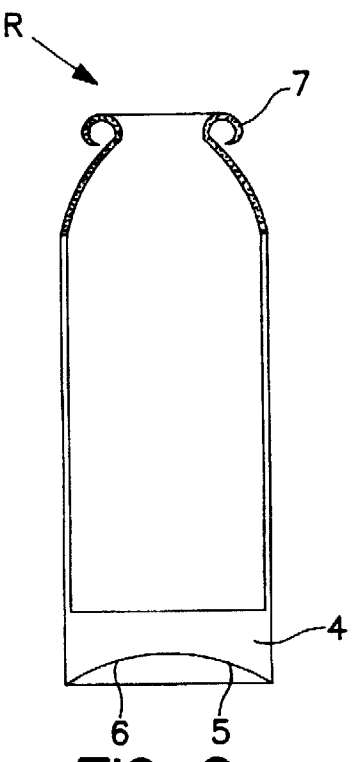
FIGS. 2*a* through 2*f* show a cut top view of a two-chamber package in different stages of the process of its manufacture in accordance with the present invention.
Figure 2D:
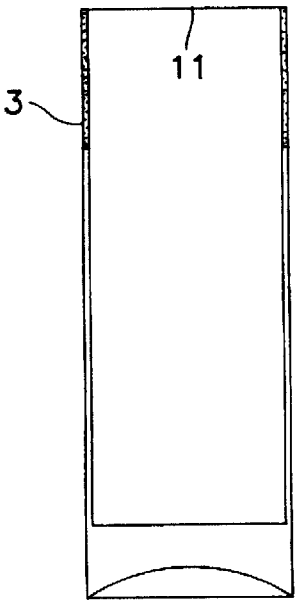
Figure 2C:
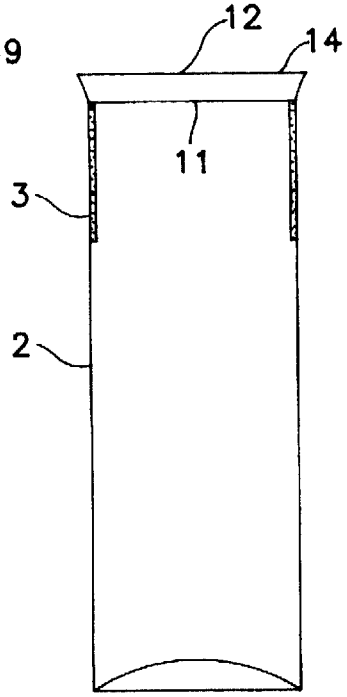
Figure 2B:
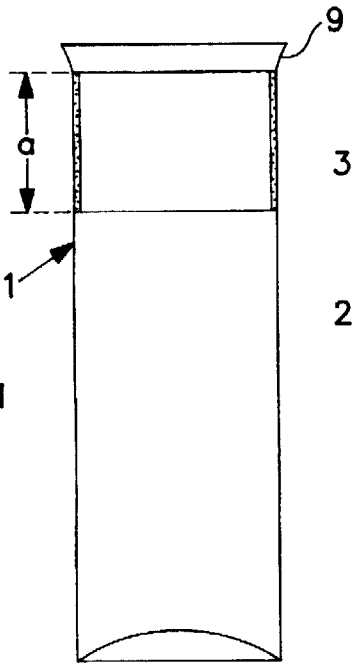
Figure 2A:
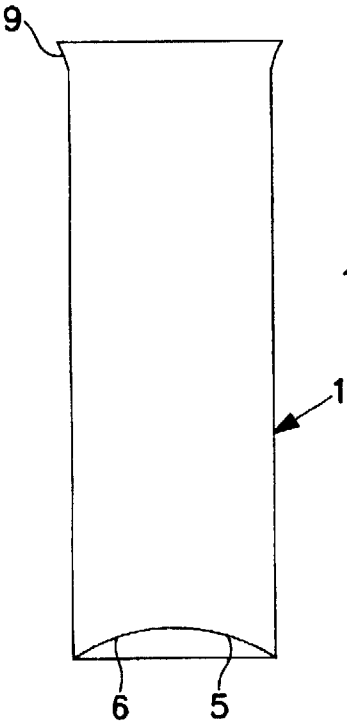
Figure 2F:
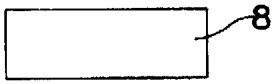

In accordance with the prior art shown in FIG. 1 a two-chamber pressure package R consists of an outer casing 1 as well as. an inner body 2. The inner body, 2 is connected with the outer casing 1 only in a specific upper area a (bonding zone) on an adhesive layer 3. Otherwise an inner space 4, which is filled with a pressure medium through a hole 5 in an arched bottom 6, is formed between inner body 2 and outer casing.

The inner body serves for holding a product to be brought out of a valve not shown for the sake of easy visibility. This valve, respectively a valve cover, in which the valve sits, is set on a bead 7.

This two-chamber pressure package R is produced according to FIGS. 1*a* through 1*e* as follows:

The outer casing 1 is drawn from a circular piece of metal 8, in particular aluminum. For example, this takes place by means of a known deep-drawing, respectively pressure deep-drawing process. During the process or after it, at the same time the bottom 6 is arched and the bottom hole 5 either is punched out or only prepunched, so that in the last case a punched circle is pressed out by means of a later vacuum setting of the bottom 6 and the hole is made. Moreover the bottom 6 does not have to be arched, it can also remain flat. Of course an arched bottom 6 has proven itself to be favorable in the case of pressurizing the inner space 4.

Further an edge area 9 of the outer casing 1 is expanded in order to be able to place the outer casing 1 better in a further work step.

Then an adhesive is applied, for example sprayed, in an area a to an outer surface 10 of the inner casing 1 or outer surface of the inner body 2. Different glues or plastics can be considered as adhesives.

The inner body 2 is inserted, respectively made, in a further work step. This inner body 2 consists of any thin, crumblable material, such as, for example, a plastic or a thin metal, in particular aluminum foil. This inner body 2 can be inserted as a whole into the outer casing 1, or it is sprayed in, poured in, or the like. . . There are also many methods here which are covered by the present invention.

In each case the inner body 2 is attached to the outer casing I by means of the adhesive layer 3 in the area a, while otherwise it is not connected with the inner surface 10 in the interior of the outer casing 1.

If after pressurizing the inner space 4, a product located in the inner body 2 is released through a valve, this inner body 2 is pressed together and crumpled under the pressure in the inner space 4, so that the volume of the inner space is elevated and the volume of the inner body 2 is reduced. The product is pressed out of the valve in this way.

An upper edge 11 of the inner body 2 ends at a distance b from an opening edge 12 of the outer casing 1. There is neither an adhesive nor material of the inner body 2 in this space b.

Now the upper part of the outer casing 1 is drawn in together with the inner body 2 in the area of a part of the adhesive layer 3 in a usual known beading tool. Then the part of the outer casing 1 between edge 11 and opening edge 12 and also a part of the adhesive are 3 connected with it are folded outward or inward and made into a bead 7.

According to this production process the product to be released can be put into the inner body 2 and an opening 13 of the two-chamber pressure package R closed with a valve. Now also the inner space 4 is pressurized through the hole 5, if necessary a prepunched circle being broken out of the hole 5 by means of this pressurization of the inner space 4.

The process in accordance with the invention as shown in FIGS. 2*a* through 2*f* differs from this process in accordance with the state of the art as follows:

After the insertion or production of the inner body 2 in the outer casing 1 and the connection of inner body 2 with the adhesive layer 3, an upper ring 14 then is removed to the opening edge 12, preferably up to the edge 11 or even beyond that. The removal preferably is performed by milling, but also there are other possibilities, such as cutting.

In the present embodiment this ring 14 is expanded more. However, this is not absolutely necessary, since an expansion in this sense is not absolutely necessary for the further process.

Aflter the removal of the ring 14 the outer casing 1 together with the inner body 2, as known, is inserted and the bead 7 is made. In this case the insertion is made by means of a higher number of drawing stages in comparison with the state of the art, avoiding a fold formation and thus leakages between outer casing I and inner body 2.

Figure 3:
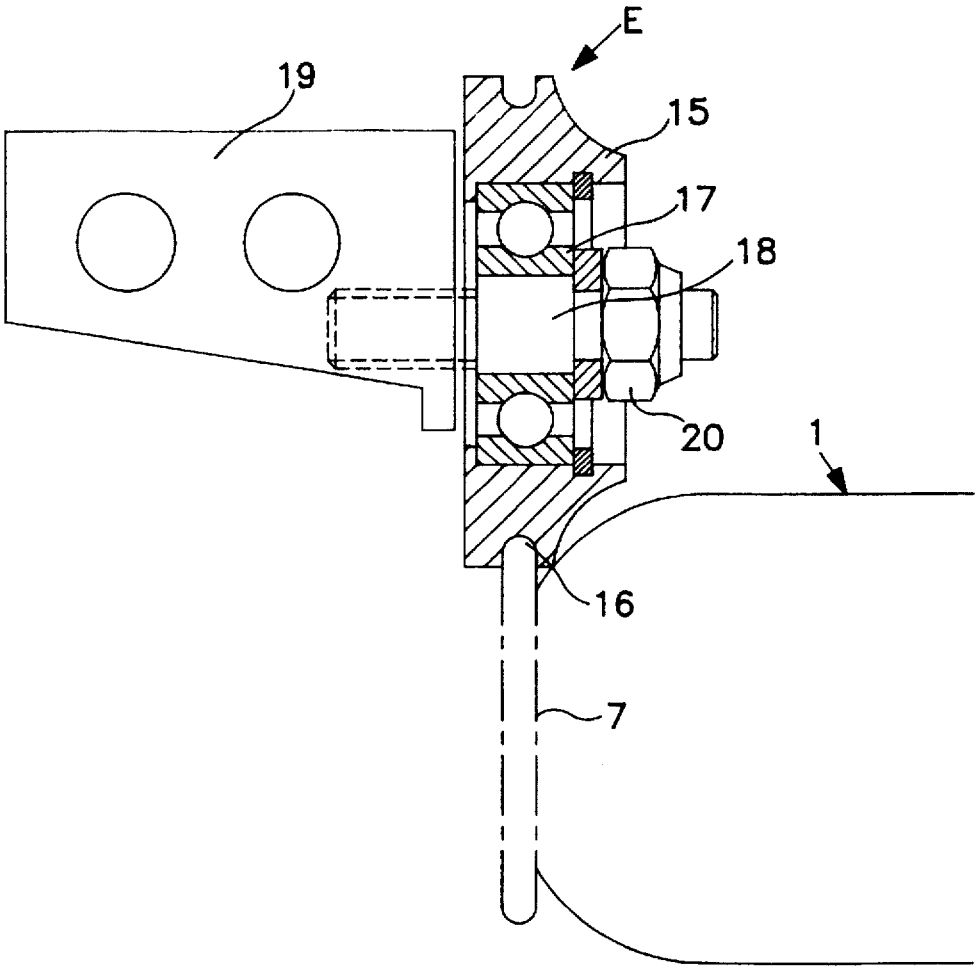
FIG. 3 shows a partially cut top view of a rerolling tool in accordance with the invention.

Since the bead 7 is made in the area of the adhesive layer 3, it has been shown in practice that the inner body 2 and also the adhesive layer 3 in the area of the open bead 7 is made unattractively jagged or ragged. For this reason a rerolling should be carried out, which is performed with a rerolling tool E. This rerolling toll E according to FIG. 3 has a rolling ring 15 with a peripheral groove 16 for the bead 7 of the two-chamber pressure package B. The peripheral groove 16 has a contour which match es the contour of the bead .

The rolling ring 15 sits with a ball bearing 17 of a shaft 18, which is screwed into a shaft block 19 and is secured by a nut 20.

I claim:

1. A process for producing a two-chamber pressure package having an outer casing defining an opening edge and an inner casing connected to the outer casing by means of an adhesive layer forming a bonding zone between the outer casing and the inner casing wherein the bonding zone has an upper edge which is spaced a distance b from the opening edge whereby the outer casing defines a ring extending from the upper edge of the bonding zone to the opening edge, the improvement comprising: removing the ring at the upper edge of the bonding zone thereby forming a new opening edge formed by the outer casing, adhesive layer and inner casing; and forming a bond with the new opening edge.

2. A process according to claim 1 including the step of milling the ring at the upper edge of the bonding zone so as to remove the ring.

* * * * *